US011511448B2

(12) United States Patent
Efthimiadis et al.

(10) Patent No.: US 11,511,448 B2
(45) Date of Patent: Nov. 29, 2022

(54) RAZOR CARTRIDGES

(71) Applicant: BIC-VIOLEX SA, Anixi (GR)

(72) Inventors: Dimitrios Efthimiadis, Athens (GR); Panagiotis Kopelas, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 449 days.

(21) Appl. No.: 16/622,491

(22) PCT Filed: Jun. 16, 2017

(86) PCT No.: PCT/EP2017/064849
§ 371 (c)(1),
(2) Date: Dec. 13, 2019

(87) PCT Pub. No.: WO2018/228709
PCT Pub. Date: Dec. 20, 2018

(65) Prior Publication Data
US 2021/0162613 A1 Jun. 3, 2021

(51) Int. Cl.
*B26B 21/22* (2006.01)
*B26B 21/40* (2006.01)

(52) U.S. Cl.
CPC ..... *B26B 21/227* (2013.01); *B26B 21/4012* (2013.01)

(58) Field of Classification Search
None
See application file for complete search history.

(56) References Cited

U.S. PATENT DOCUMENTS

| | | | | |
|---|---|---|---|---|
| 4,200,976 A | | 5/1980 | Gooding | |
| 4,868,983 A | | 9/1989 | Francis | |
| 5,416,974 A | * | 5/1995 | Wain | B26B 21/227 30/57 |
| 5,546,660 A | * | 8/1996 | Burout | B26B 21/227 30/48 |
| 7,200,938 B2 | * | 4/2007 | Lembke | B26B 21/227 30/527 |
| D816,907 S | * | 5/2018 | Zucker | D28/47 |
| 2005/0172489 A1 | | 8/2005 | Aviza | |

(Continued)

FOREIGN PATENT DOCUMENTS

| | | |
|---|---|---|
| CN | 1917988 A | 2/2007 |
| CN | 101528426 A | 9/2009 |

(Continued)

OTHER PUBLICATIONS

International Search Report in corresponding Application No. PCT/EP2017/064849, dated Feb. 22, 2018 (5 pages).

(Continued)

*Primary Examiner* — Hwei-Siu C Payer
(74) *Attorney, Agent, or Firm* — Bookoff McAndrews, PLLC

(57) ABSTRACT

A shaving cartridge including a housing, a guard bar, a cap and cutting elements. The housing including an inner receiving portion and an inner attaching portion. The cutting elements further including a connecting structure at each end for connection of the cutting elements either on the housing or between adjacent cutting elements to thereby form a chain-like effect.

9 Claims, 15 Drawing Sheets

(56) References Cited

U.S. PATENT DOCUMENTS

| | | | | |
|---|---|---|---|---|
| 2009/0113716 | A1* | 5/2009 | Wain | B26B 21/4068 30/346.59 |
| 2010/0005664 | A1* | 1/2010 | Aviza | B26B 21/4068 30/50 |
| 2013/0205595 | A1 | 8/2013 | Bykowski et al. | |
| 2014/0059862 | A1* | 3/2014 | Efthimiadis | B26B 21/225 30/50 |
| 2015/0314466 | A1* | 11/2015 | Papadopoulos-Papageorgis | B26B 21/222 30/526 |
| 2021/0162613 | A1* | 6/2021 | Efthimiadis | B26B 21/4012 |

FOREIGN PATENT DOCUMENTS

| | | | | |
|---|---|---|---|---|
| CN | 104884212 | A | | 9/2015 |
| DE | 202013002343 | U1 | | 4/2013 |
| EP | 0293683 | A2 | | 12/1988 |
| EP | 0 858 869 | A1 | * | 8/1998 |
| GB | 2 131 337 | A | * | 6/1984 |
| JP | H02500337 | A | | 2/1990 |
| WO | 9610472 | A1 | | 4/1996 |
| WO | WO 98/05478 | | * | 2/1998 |
| WO | 2014139655 | A2 | | 9/2014 |
| WO | WO 2017/161341 | A1 | * | 9/2017 |

OTHER PUBLICATIONS

Chinese Search Report issued in CN Application CN2017800907504 dated Nov. 29, 2021 (2 pages).
English Translation of Chinese Office Action issued in Chinese Application CN201780090750.4 dated Feb. 1, 2021 (3 pages).

* cited by examiner

RAZOR CARTRIDGES

CROSS REFERENCE TO RELATED APPLICATION(S)

This application is a National Stage Application of International Application No. PCT/EP2017/064849, filed on Jun. 16, 2017, now published as WO2018228709.

FIELD

The disclosure relates to razor cartridges for shaving razors, the razor cartridges include a plurality of blades supported in the razor cartridges with chain like supports.

BACKGROUND

Razor cartridges with movable blades are commonly known to have specific structures in order to support the blades. These structures may include elastic members and slots. However, these supportive means are in a limited space and prevent water from rinsing away debris accumulated during shaving. Also, if the cartridge is configured to be flexible or pivot in order to follow the skin contour, the above-mentioned structures may reduce the ability of the blades to follow closely the movement of the cartridge, therefore not delivering the closest shave.

Other commonly known supports are grid-like frame blade supports However, the grid simultaneously guides all the blades to the same movement, thus harming the performance of the shaver.

SUMMARY

According to the disclosure, the razor cartridge may include a housing having a front wall, a back wall opposing the front wall, retaining structures, at least one cutting element having a first end and a second end, and the cutting element having connecting structures at the first end and at the second end, the connecting structures allowing the cutting element to be attached to the housing.

Further, the disclosure also relates to methods of manufacturing razor cartridges, wherein the methods include:

- providing a housing having a front wall, a rear wall opposing the front wall, and retaining structures,
- providing at least one cutting element having a first end and a second end, the cutting element having connecting structures at the first end and at the second end,
- mounting the at least one cutting element on the housing between the front and the rear walls, such that the connecting structures are attached to the retaining structures of the housing.

BRIEF DESCRIPTION OF THE DRAWINGS

Other characteristics and advantages of the disclosure will readily appear from the following description of embodiments, provided as non-limitative examples, in reference to the accompanying drawings.

DETAILED DESCRIPTION

Figure 1A:
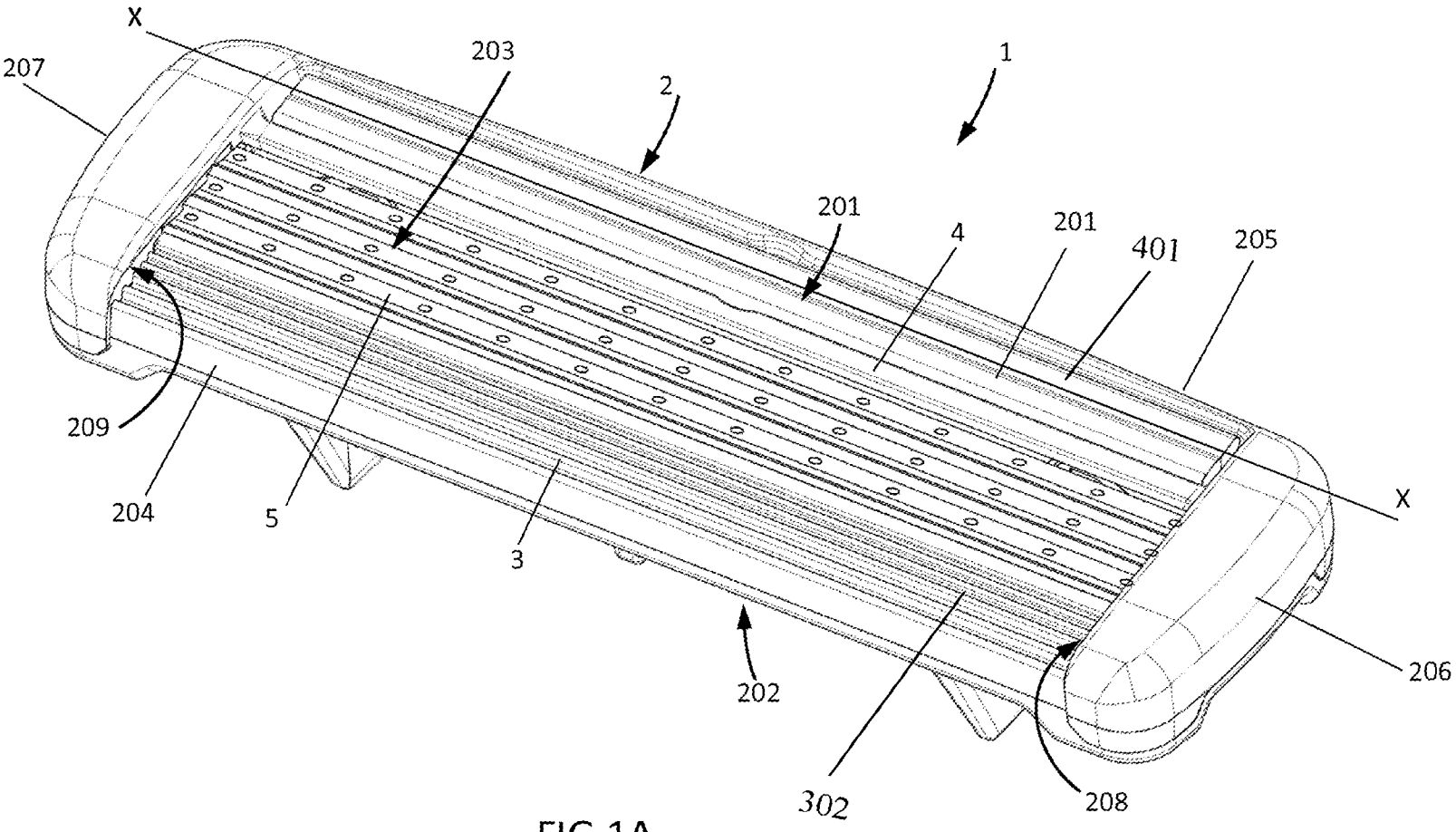
FIG. 1A is a perspective view of an aspect of the razor cartridges.

According to the present disclosure, although the term "shaving cartridge" is used extensively, a person skilled in the art should understand that there are alternative terms to describe" shaving cartridge", e.g. shaving head. For that reason, an interchange of the terms shaving cartridge and shaving head shall cause no confusion. In addition, the term "cutting element(s)" should be known to a person skilled in the art also as "blade(s)", and an interchange of these two terms shall again cause no confusion.

Shaving cartridges, as presently disclosed, may improve rinsability and thus a shave by supporting the cutting elements on a side of the cutting elements and allowing the cutting elements to closely follow skin contours. The cutting elements may be retained in the shaving cartridge without additional elements, resulting in a maximum functional length of the cutting elements, and/or a larger area on the shaving cartridge for additional accessories, such as, for example, shaving aid(s).

According to aspects, the shaving cartridges may include a housing having a front wall, a back wall opposing the front wall, an inner left side, an inner right side opposing the inner left side, a first retaining structure on the inner left side, and a second retaining structure on the inner right side, at least one cutting element having a first end and a second end, and the cutting element having a first connecting structure at the first end and a second connecting structure at the second end, and first and second connecting structures may be attached to the first and second retaining structures of the shaving cartridge.

As such, the shaving cartridge may not require additional cutting element supports, such as elastic fingers at the sides of the housing, or cutting element guides under the cutting elements, thus improving rinsability, easing manufacturing, requiring less parts to manufacture and assemble, and ultimately reducing costs.

According to aspects, one or more of the following features may be incorporated in the shaving cartridges, alone or in combination:

The shaving cartridges, may include housing retaining structures, each housing retaining structure may have a housing attaching portion and/or a housing receiving portion.

The shaving cartridges may include at least one cutting element, each cutting element may include connecting structures, at least one of the connecting structures may include a cutting element attaching portion and/or a cutting element receiving portion.

According to further aspects, the shaving cartridge may have a housing receiving portion including a recess, and may have a housing attaching portion including a protrusion. The overall functional length of the cutting elements may be increased, which may result in a more efficient performance of the shaving cartridge, since more hairs may be cut with one shaving stroke.

In addition, the shaving cartridges may have a cutting element first, after the housing front wall and a cutting element last, before the housing rear wall attached to the housing.

The use of additional retaining means to secure the cutting elements in the housing, may result in the clogging of cut hair, and in hair being pulled during a shave. Direct attachment of the cutting elements to the housing, without any additional retaining means, may reduce clogging and pulling, and may therefore improve the shaving experience.

Furthermore, since the described attachment and structures of the shaving cartridge may allow a larger area on the top of the housing to be available for use, additional components, for example, skin care element(s), may be used. Also, the available area on the top of the housing may be used for any other structure that may enhance shaving and improve the shaving experience, for example, a skin adaptor. In addition, the shaving cartridge and the cutting elements that are attached between may form a chain-like effect and may allow the cutting elements to move and rotate more freely, therefore avoiding possible deformation due to the forces applied during shaving. Since the forward cutting element may lead the adjacent or following cutting element to have the same movement while contacting the same skin contour, the perceived shaving performance of the shaving cartridge may be enhanced.

The cutting elements may be attached between the chain-like supports, forming a self-supported chain, and may allow for the production of cartridges having a different number of cutting elements, without the need for additional design or development of a different shaving cartridge. As it will be understood, the movement of the cutting elements during shaving, and their return to their rest position, have been considered.

According to aspects, as shown in FIG. 1, a shaving cartridge 1 may include a housing 2, a guard bar 3, a cap 4, and cutting elements 5. The housing 2 may include a top side 201, and a bottom side 202 opposite the top side 201. On the top side 201 a window 203 may be formed, through which the cutting elements 5 may be exposed. The housing 2 may further include a front wall 204, extending along X axis, a rear wall 205 opposite the front wall 204, a right wall 206, extending between the front wall 204 and the rear wall 205, and a left wall 207 opposite the right wall 206. Each of the right and left walls 206 and 207 may include an inner surface 208 and 209 respectively, extending between the front and the rear walls 204 and 205, and facing towards the window 203 of the top side 201 of the housing 2. The cap 4 may include a shaving aid 401, for example a lubrication strip or any other known skin care element that may enhance glideness or the like during shaving. The guard bar 3 may be flat or may have any other suitable structure, for example fins, that may be made of the same or a different material than the housing, aiming at engaging the skin 6 and improving the shaving performance. The guard bar 3 may extend in a plane [[P]] perpendicular to at least one wall of the housing 2, or the guard bar 3 may extend in another direction forming an angle with either the right wall 206 or left wall 207 or with each right and left wall 206, 207 of the housing.

Figure 1B:
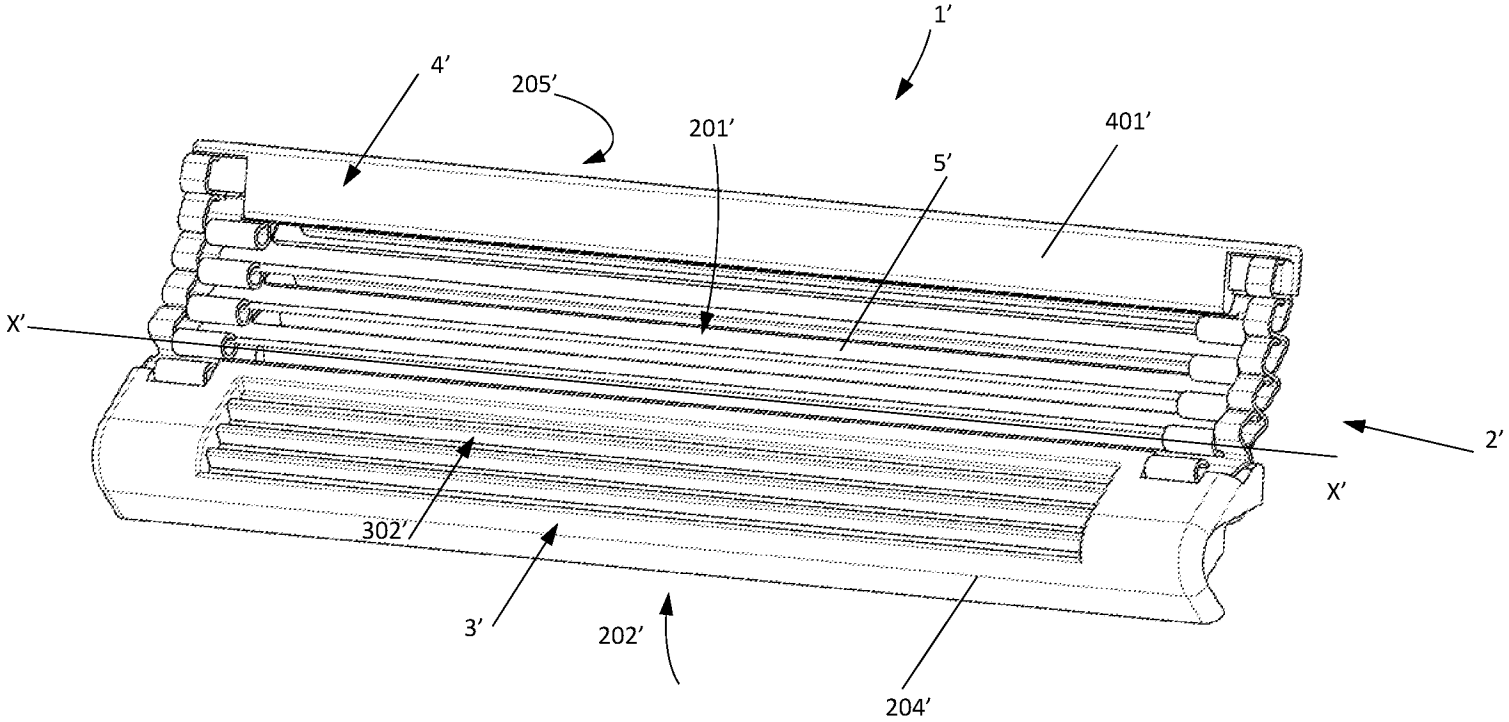
FIG. 1B is a perspective view of another aspect of razor cartridges.

According to other aspects, as shown in FIGS. 1B, 2B, 3B, and 4B, the shaving cartridge 1' may include a housing 2', a guard bar 3', a cap 4', and cutting elements 5'. The housing 2' may include a top side 201', and a bottom side 202' opposite the top side 201'. The top side 201' may not include a window, since the housing 2' may not include side walls, and a frame is not formed. After the guard bar 3', which may be optional, and before the cap 4', which may also be optional, the cutting elements 5' may be exposed. The housing 2' includes a front wall 204', extending along X' axis, and a rear wall 205' opposite the front wall 204'. The cap 4' may have a retaining structure 41' (FIG. 3B) which may include an attaching portion 411' (FIG. 3B) in the form of a protrusion 4111', which may have a width W'. The cap 4' may include a support portion 402' (FIG. 2B) and a shaving aid 401' (FIG. 1B) mounted on the support portion 402', for example a lubrication strip or any other known skin care element that may enhance glideness or the like during shaving. The guard bar 3' may include a support portion 301' (FIG. 2B) and a skin contact portion 302' (FIG. 1B). The guard bar 3' may have a second retaining structure 31' (FIG. 3B) which may include a receiving portion 310' in the form of a recess or a tube-like shape 3101'. According to further aspects (not shown), the cap 4' may include the receiving portion, while the guard bar may include the attaching portion. The guard bar 3' may also include an extending portion, for example, a leg 32' which may function as a return element for the cutting elements 5' when the shaving cartridge 1' may not be in contact with the skin anymore and the cutting elements 5' need to return to a rest position. The guard bar 3' may be flat or may have any other suitable structure, for example fins, that may be made of the same or a different material than the housing 2', aiming at engaging the skin 6 and improving the shaving performance. The guard bar 3' may extend in a plane [[P']] parallel to at least one the front wall 204' or rear wall 205' of the housing 2', or the guard bar 3' may extend in another direction forming an angle with either the front wall 204' or rear wall 205' or with each of front wall 204' and rear wall 205' of the housing 2'.

The cutting elements 5,5', as shown in FIGS. 1A and 1B, may all be adjacent within the housing 2,2'. However, a different arrangement may be possible. For example, the cutting elements 5,5' may be intermediate the skin contacting portions 302,302' between each of the cutting elements 5,5' or the cutting elements 5,5' may be divided into groups.

Figure 4A:
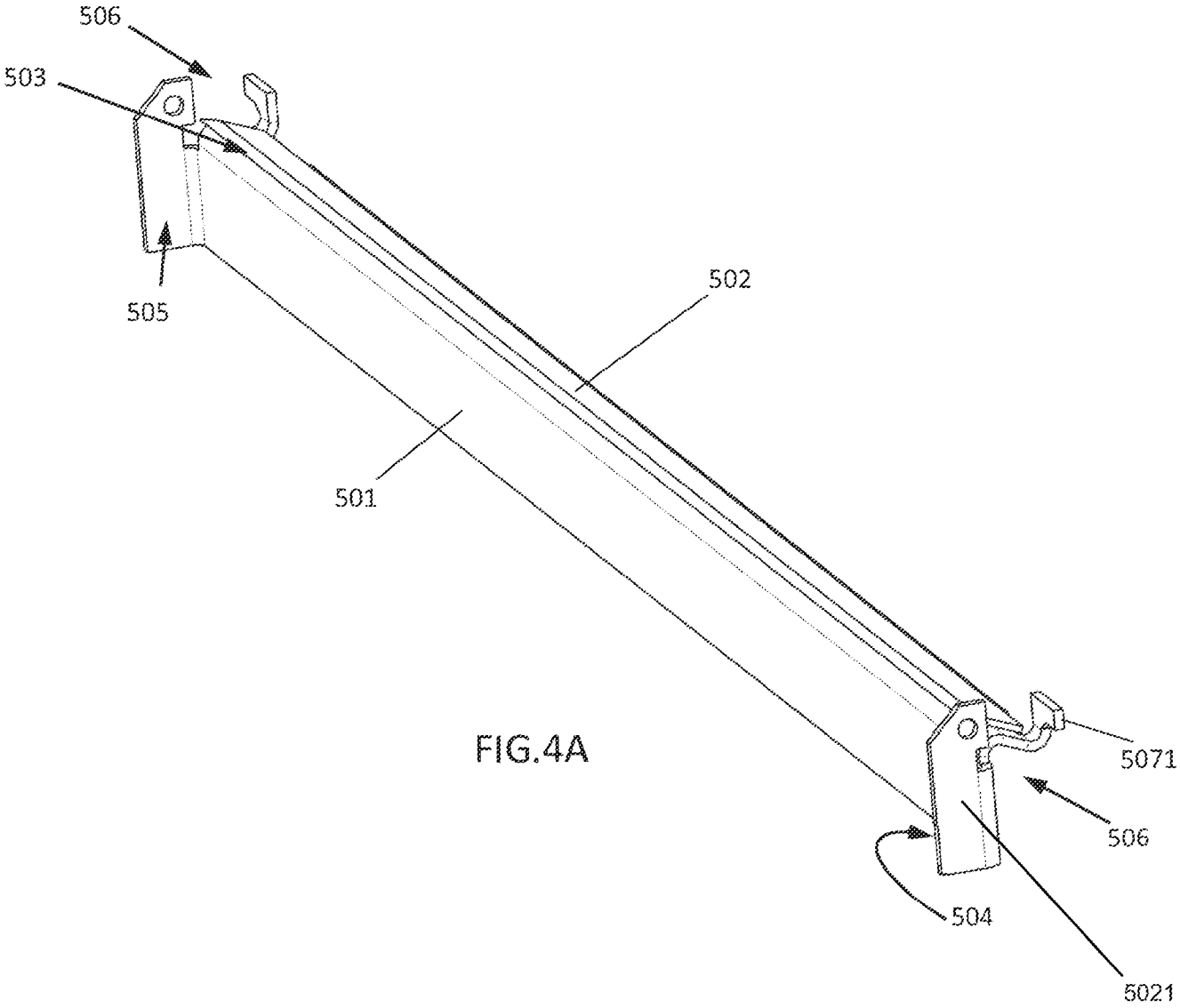
FIG. 4A is a perspective view of the cutting element.
Figure 4B:
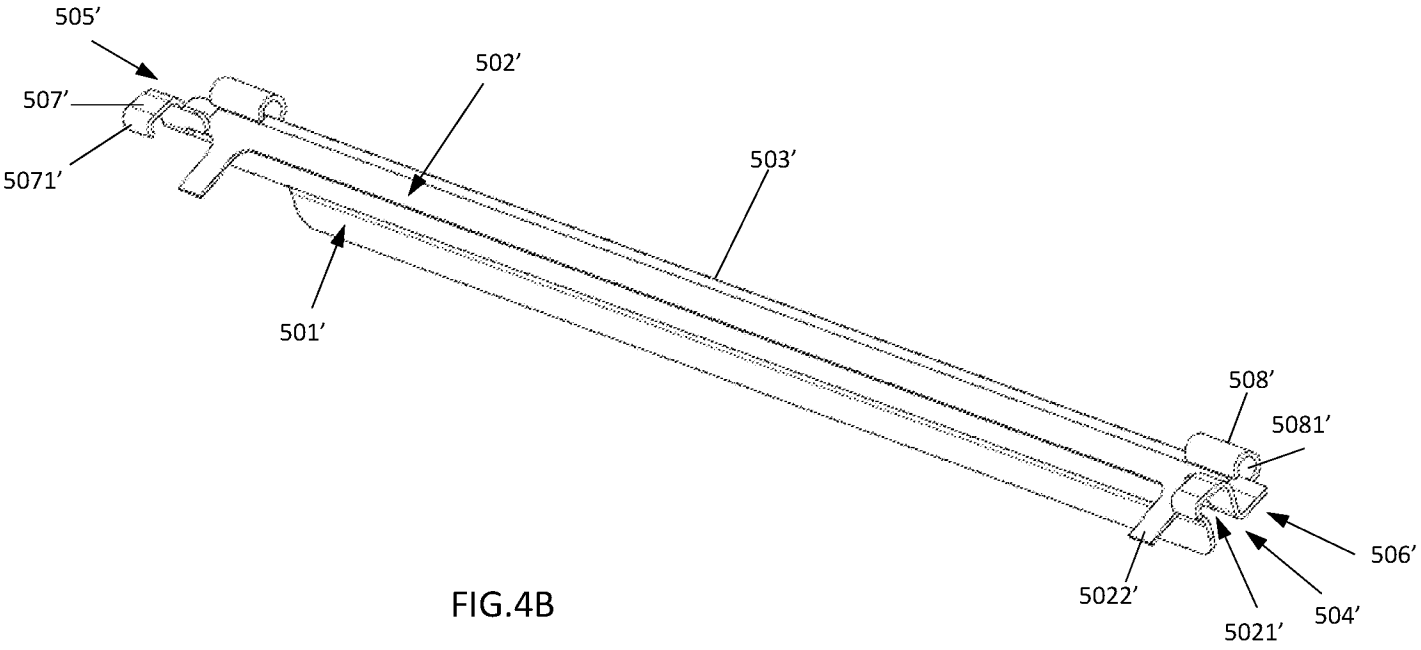
FIG. 4B is a perspective view another aspect of the cutting element.

According to further aspects, the cutting elements 5, 5' as shown in FIGS. 4A and 4B, may include a supporting portion 501, 501' and a blade portion 502, 502' each blade portion may have two ends 5021, 5021' and a cutting edge 503, 503'. The blade portion 502' may also include an extending portion 5022' at each of the ends 5021' of the blade portion 502'. The extending portions 5022' may serve as return springs for the cutting elements 5,5', by forcing each of the cutting elements 5,5' to return to a rest position when the skin may no longer exert a force upon the cutting element 5,5'. The supporting portion 501, 501' and the blade portion 502, 502' of the cutting element 5, 5' may be two separate and attached components, or they may form a single unit. Each of the cutting elements 5, 5' belonging to the shaving cartridge 1, 1' may all include two attached components, or some may be a single unit.

Figure 2A:
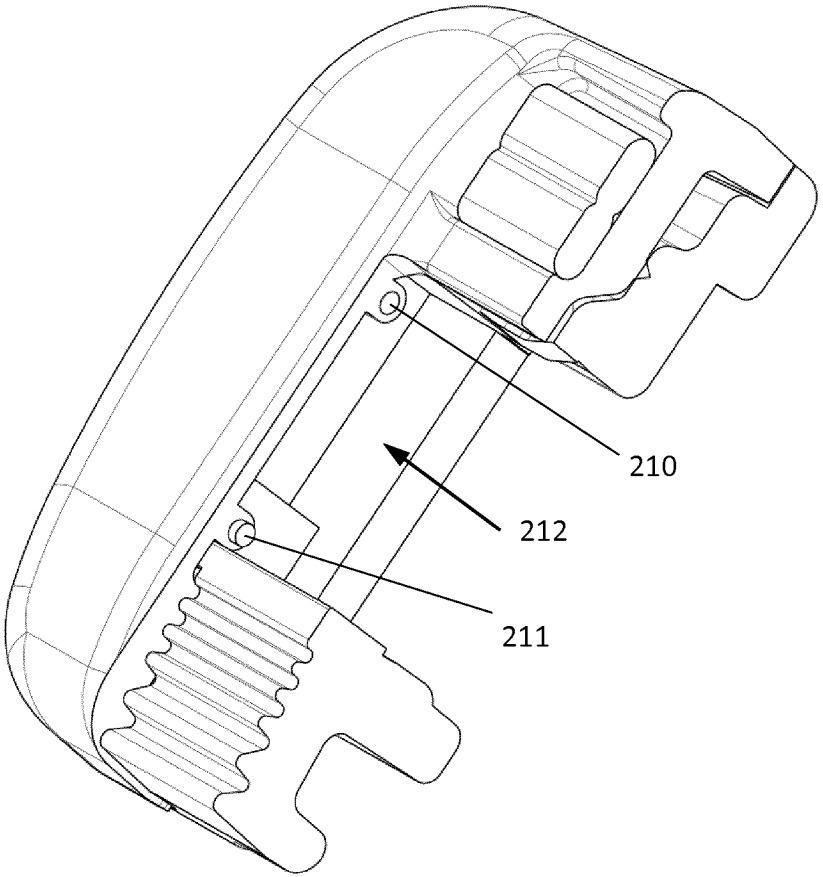
FIG. 2A is a detailed view of the housing of FIG. 1A.
Figure 2B:
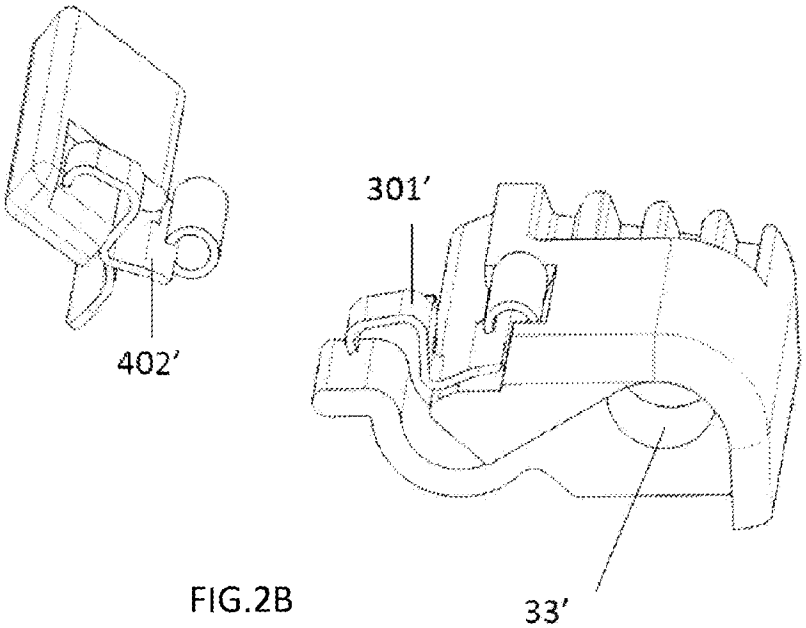
FIG. 2B is a detailed view of the housing of FIG. 1B.
Figure 3A:
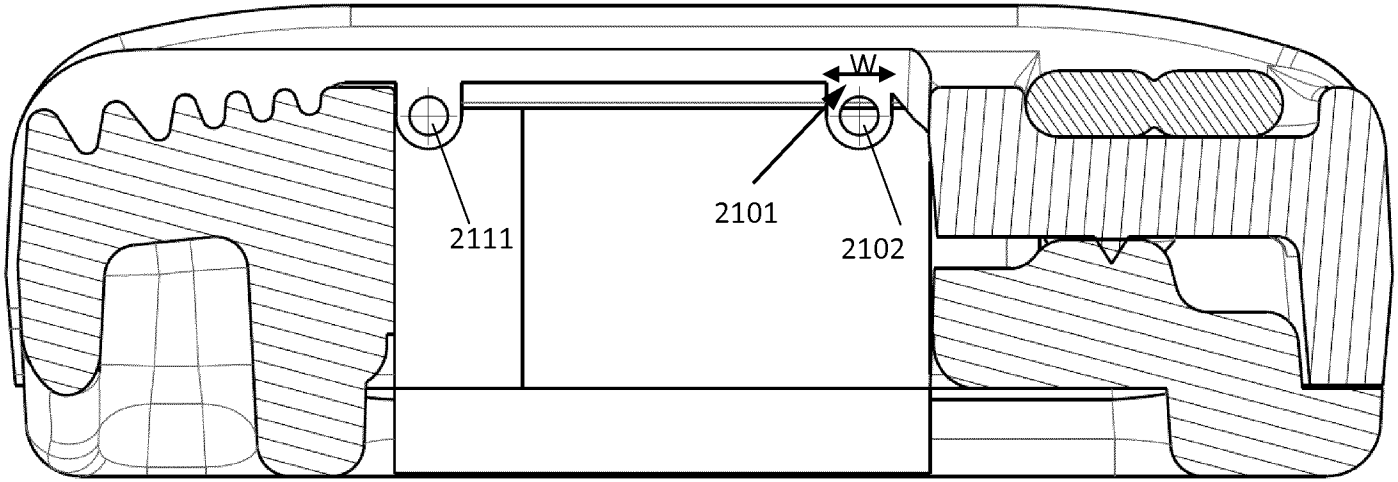
FIG. 3A is a side view of FIG. 2A.
Figure 3B:
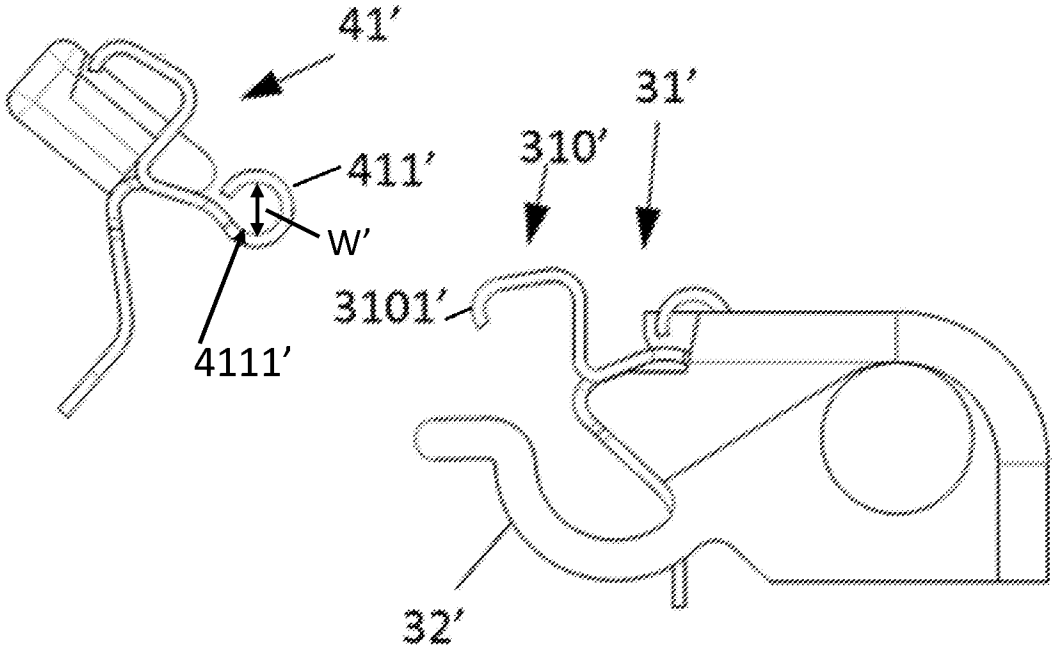
FIG. 3B is a side view of FIG. 2B.
Figure 5A:
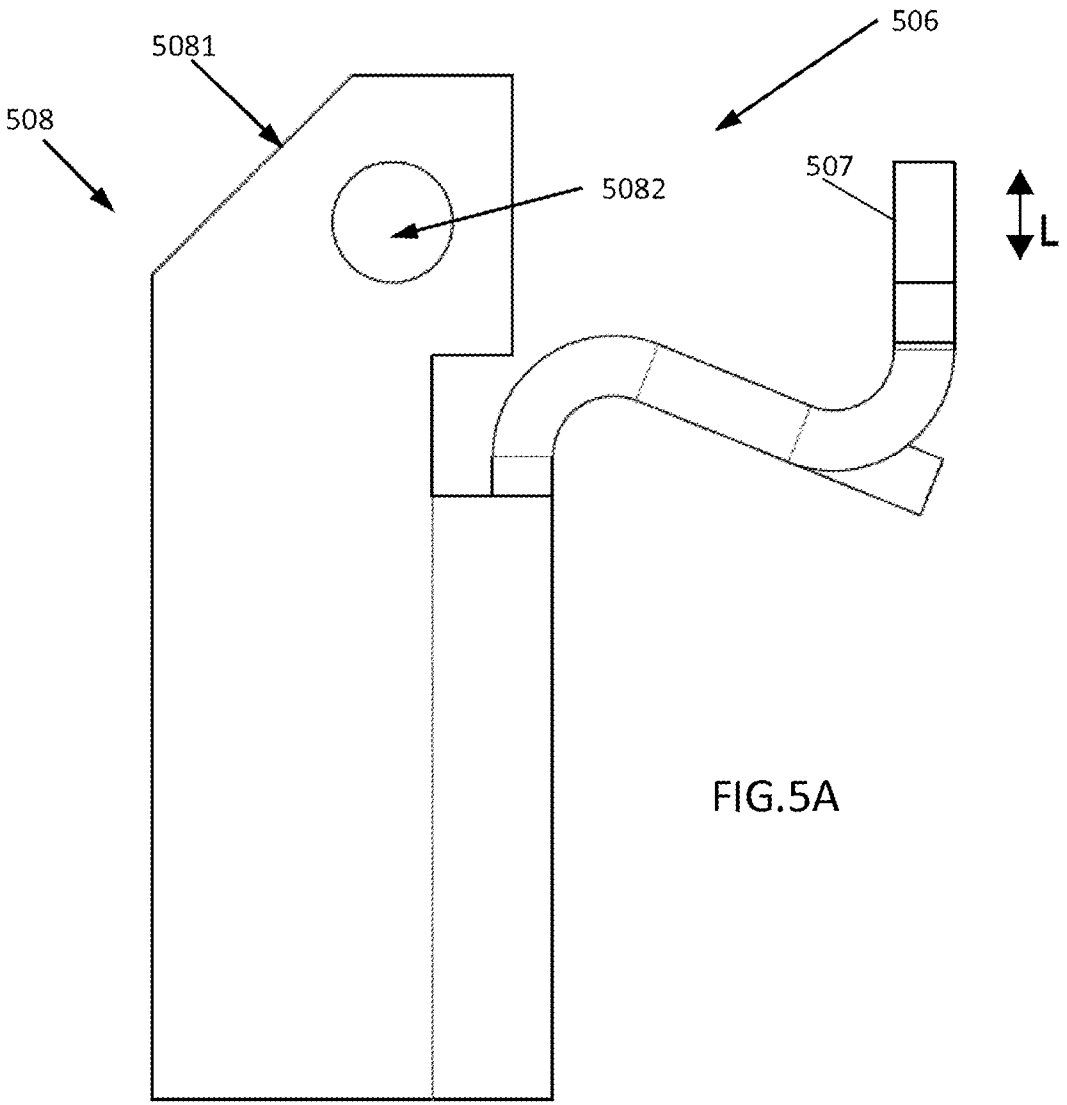
FIG. 5A is a right-side view of the support portion of the cutting element of FIG. 4A.

Each cutting element 5 may have a first end 504, and a second end 505. Each of the first and second ends 504,505 may include a connecting structure 506. The connecting structure 506 may include the attaching portion 507 and the receiving portion 508. The attaching portion 507 may have any shape that may allow the cutting element 5 to be attached to the housing 2. According to further aspects, and as shown in FIGS. 4A and 5A, the attaching portion 507 may be in the form of a protrusion 5071, which may cooperate with a recess on the left and right inner surfaces 209,208 of the housing 2. In another example, the protrusion 5071 may be a pin and/or may have small inclined ribs at an end thereof in order to snap-fitted on the housing 2. The receiving portion 508 may have any suitable shape that may enable the cutting element 5 to be more securely attached on the right and left inner surfaces 208,209 of the housing 2. Corresponding structures on the right and left inner surfaces 208,209 of the housing 2 may be a shape that may be capable of receiving the attaching portion 507, or that may cooperate with the receiving portion 508. Each of the right and left inner surfaces 208,209 of the housing 2 may include an inner receiving portion 210 and an inner attaching portion 211. The inner receiving portion 210 and the inner attaching portion 211 may form the housing retaining structure 212. The inner receiving portion 210 may have a shape corresponding to the attaching portion 507, such that the attaching portion 507 may be allowed to be attached on the inner receiving portion 210. As shown in FIGS. 2 and 3, the inner receiving portion 210 may be a linear recess 2101, and may allow the protrusion 5071 to slide on the inner surface 208 or 209. At the end of the linear recess 2101 there may be a circular end 2102, which may function as a stop portion for the protrusion 5071. The shape of the end 2102 may be different from the general shape of the protrusion 5071. For example, if the protrusion 5071 is cylindrical the end 2102 may be rectangular, circular or any other shape that may allow the protrusion 5071 to reach the end 2102 and be secured therein. The recess 2101 and the end 2102 may have larger dimension than the attaching portion 507, and may allow the attaching portion 507 to pivot with respect to the housing 2. For example, the attaching portion 507 may have a cylindrical shape, the length of the attaching portion 507 may be about 0.2 mm-0.8 mm, and according to some aspects may be about 0.5 mm, in order to secure the cutting elements 5 into the housing 2, to support movement of the cutting elements 5, and to minimize the space where cut hair and shaving debris may get clogged. The length L (FIG. 5A) of the attaching portion 507 may be about 0.2 mm-1 mm, depending on the material of the attaching portion 507. According to aspects where the attaching portion 507 may be made of a hard material which has a low elasticity, the length may be about 0.2 mm, while if the material may of higher elasticity the length may be about 1 mm. The recess 2101 may have a width W of about 0.8 mm-1.50 mm. The attaching portion 507 may be made of aluminum, thus providing anti-corrosion resistance. According to further aspects, where the attaching portion 507 may be made of an iron-based material, the inner receiving portion 210 may include a recess 2101 with a magnet. Therefore, the attachment of the cutting elements 5 to the housing 2 may be due to magnetic force and may also allow the cutting elements 5 to pivot in relation to the housing 2.

According to other aspects, the attaching portion 507 may be retractable and the inner receiving portion 210 may include a recess in the form of a through hole.

The receiving portion 508, may include a recess 5082 or a through hole having wherein the recess 5082 may be adapted to receive the inner attaching portion 211 of the housing 2. The receiving portion 508 may have a shape corresponding to the shape of the inner attaching portion 211, or may have any other shape appropriate for receiving and securing the inner attaching portion 211. The shape of the inner attaching portion 211 may be the same as the shape of the attaching portion 507, or the shape of the inner attaching portion 211 may be different, without deviating from the scope of the current disclosure. According to some aspects, the inner attaching portion 211 may include a protrusion 2111, for example a pin, which may have the same shape and dimension with the attaching portion 507. As shown in FIG. 5, the receiving portion 508 may be in the form of a flat portion 5081, the flat portion may include a recess 5082 of the same shape and dimensions as the inner receiving portion 210.

Figure 5B:
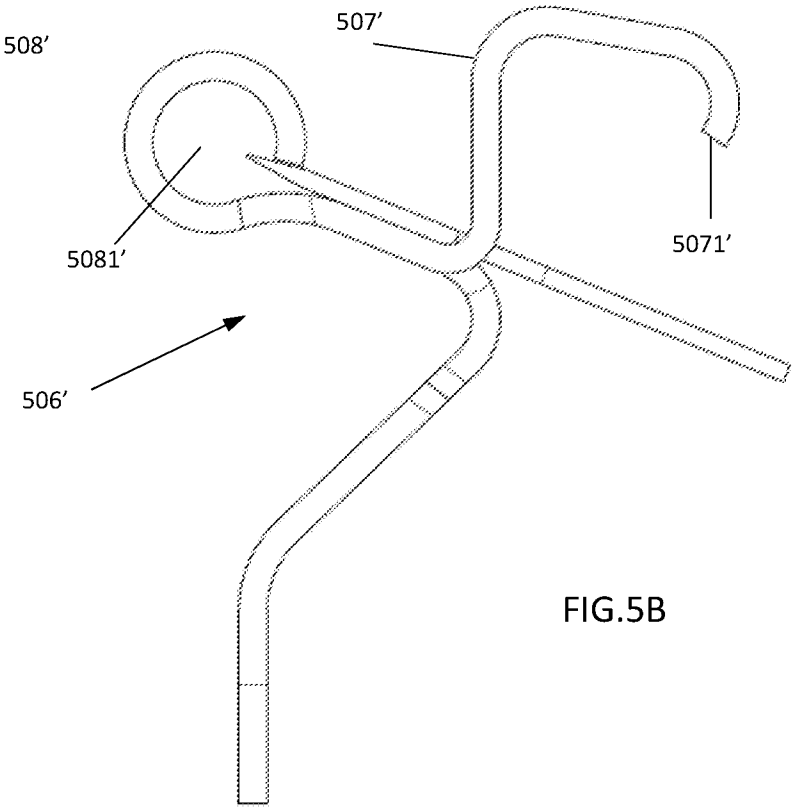
FIG. 5B is a right-side view of the support portion of the cutting element of FIG. 4B.

According to further aspects, as shown in FIGS. 4B and 5B each cutting element 5' may have a first end 504', and a second end 505'. Each of the first and the second ends 504', 505' may include a connecting structure 506'. The connecting structure 506' may include the attaching portion 508' and the receiving portion 507', which may include a receiving recess 5071'. The attaching portion 508' may have any shape suitable for allowing the cutting element to be attached to the housing 2'. The attaching portion 508' may be a protrusion 5081', which may cooperate with a receiving recess 3101' on the guard bar 3'. According to other aspects, the protrusion may be a pin and/or may have small inclined ribs at an end thereof in order to be snap-fitted into the recess 3101'. The receiving portion 507' may have any shape suitable for enabling the cutting element 5' to be more securely attached on the attaching protrusion 4111' of the cap 4'.

The second retaining structure 31' formed on the guard bar 3', and receiving portion 507' formed on the cutting element 5' may extend above blade portion ends 5021' of the cutting element 5' and may provide an additional functionality, i.e. protecting the skin of a user from coming in contact with blade portion ends 5021' of the cutting element 5', which may be sharp and aggressive, and may cut the skin accidently.

The connecting structures 506 may support the cutting elements 5 while they are attached on the housing 2. Each connecting structures may allow the cutting element 5 to move and follow the skin contour 6 more accurately in comparison to known shaving cartridges.

Figure 6A:
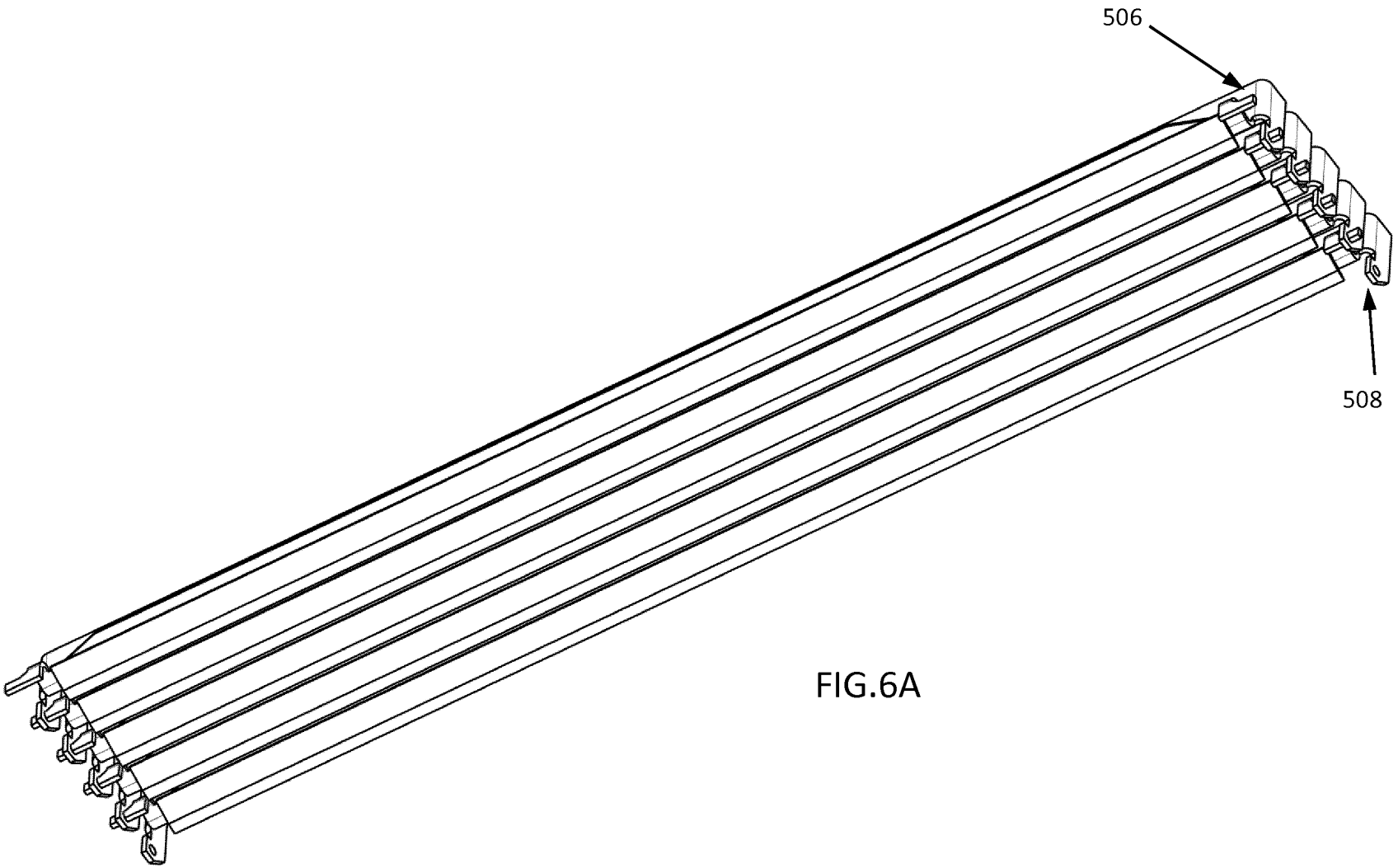
FIG. 6A is a perspective view of a chain-like support system.
Figure 6B:
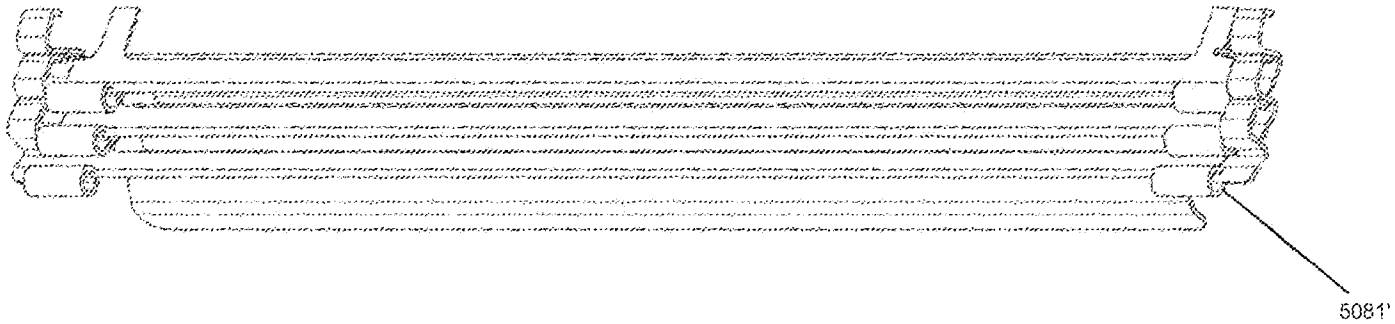
FIG. 6B is a perspective view of a chain-like support system with the connecting structure of FIG. 4B.
Figure 7A:
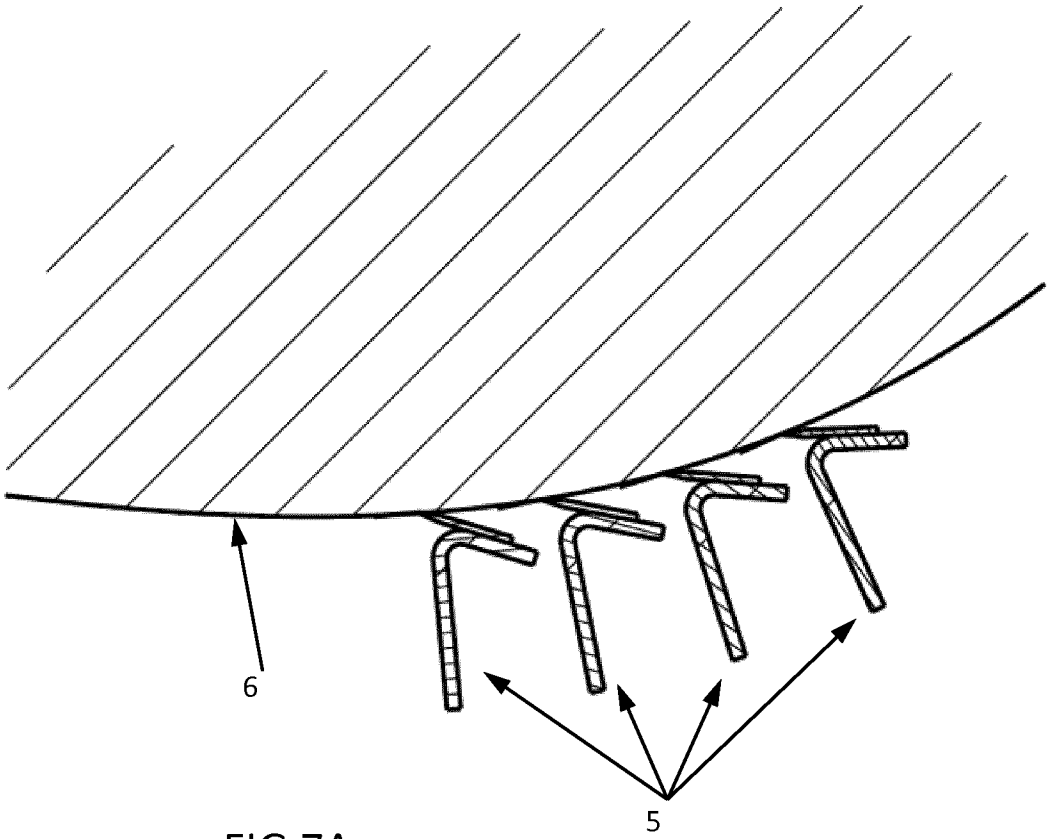
FIG. 7A is a partial cross-sectional view of a chain-like support system during shaving a convex skin surface.
Figure 7B:
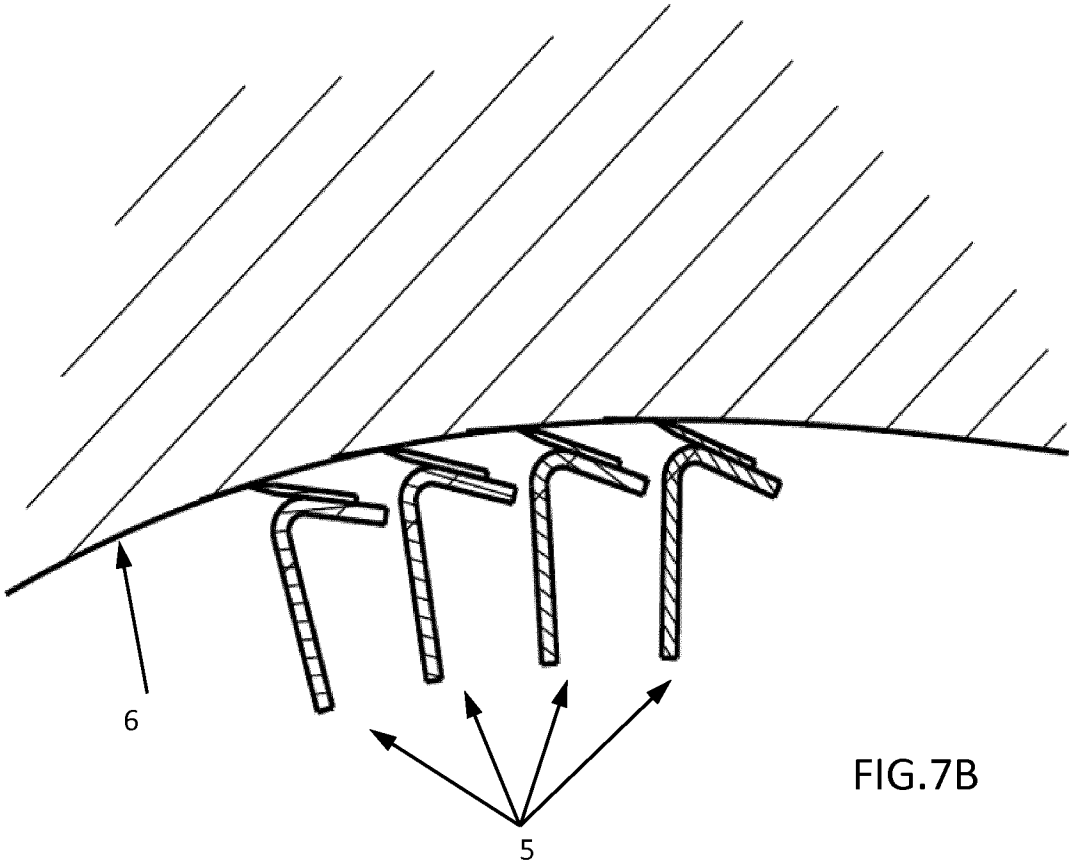
FIG. 7B is a partial cross-sectional view of a chain-like support system during shaving a concave skin surface.
Figure 8:
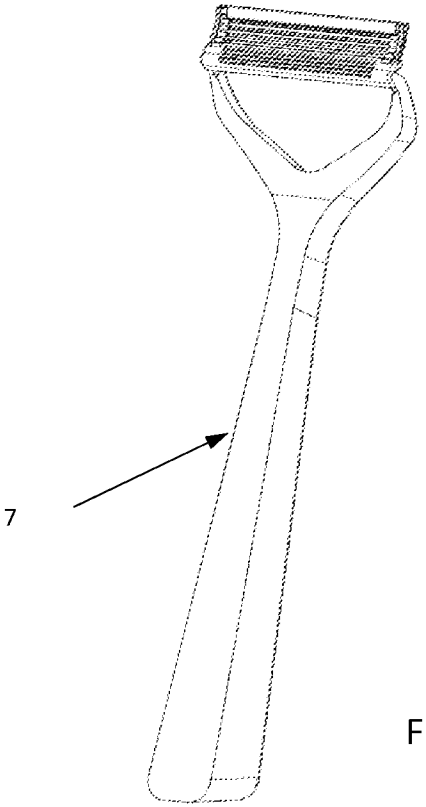
FIG. 8 is a perspective view of a shaver including a handle and the razor cartridge of FIG. 1B.

According to further aspects, the housing 2 may include at least three cutting elements 5, as shown in FIG. 4A. Each of the cutting elements 5 may have a connecting structure 506 and be attached to an adjacent cutting element 5 instead of being attached on the housing 2. Only the cutting element 5 immediately after the guard bar 3 and the cutting element 5 immediately before the cap 4 may be attached directly to the housing 2, leaving the rest of the cutting element to be attached to each other and hanging in the shaving cartridge. As detailed in FIG. 6, the cutting elements 5 may be attached between connecting structure 506, thus forming a cutting element chain hanging in the shaving cartridge 1. As similar to a moving chain, where the first chain link drags and leads the adjacent chain link to mimic the same movement, the leading cutting element 5 which is attached to an adjacent cutting element 5, when moving, forces the adjacent cutting element 5 to the same movement. The effect which may resemble a chain, may be called a "chain-like effect". This phenomenon may be more visible in FIG. 6B, where again the cutting elements 5' may be attached between the connecting structures 506'. At the rest position the shaving cartridge 1 may have a concave form. When the user starts shaving, the guard bar 3 and the cap 4 may be the surfaces that come in contact with the skin first. The user may then exert a force on the shaving cartridge 1, and on the cutting elements 5, which may start adapting to the force and move in order to obtain a position, thus resulting in a shaving cartridge shape that may correspond to the skin contour 6. In more detail, and as shown in FIG. 7A, the cutting element 5, 5' located immediately after the guard bar 3, 3' and the cutting element 5, 5' located immediately before the cap 4, 4' may be directly attached on the housing 2, 2' and directly attached to an adjacent cutting element 5, 5'. Hence, while shaving, each cutting element 5, 5' may not move independently, but an adjacent cutting element 5, 5' in the front may force the cutting element 5, 5' to a specific movement, based on the skin contour 6. When the first cutting element 5, 5' meets a convex area of the skin contour 6, the first cutting element 5, 5' may rotate without becoming more aggressive, and due to the attachment to an adjacent cutting element 5, 5', may guide the following cutting element 5, 5' to rotate as well. According to aspects, as shown in FIG. 7B, the cutting elements 5 may diverge from each other when the skin contour 6 is concave, leaving space for the water to rinse any shaving debris.

According to further aspects, each cutting element 5 may be attached only to the housing 2. As such, each cutting element 5 may have a more independent movement without guidance from the previous cutting element 5, based on the skin contour 6. As a result, each cutting element 5 may have a relatively delayed response to the changes in the skin contour. According to aspects where adjacent cutting elements 5 may be attached between the connecting structures 506, the lead cutting element 5 may come into contact first with the skin contour 6 and may then move accordingly. At the same time, due to the chain-like effect, the lead cutting element 5 may then direct the adjacent cutting element 5 to the same movement. Therefore, the lead cutting element 5 may essentially "preparing" the adjacent cutting element 5 with how to move based on the skin contour 6.

Therefore, the various changes of the skin contour 6 may be anticipated by the lead cutting element 5, providing an immediate response, thereby allowing the user to observe an increased shaving performance of the shaving cartridge 1.

The connecting structures 506, 506' may be used for attaching the cutting elements 5, 5' to the housing 2, 2' and/or for creating a cutting element chain, to form the shaving cartridge 1, 1'. The shaving cartridge 1, 1' may be releasably or fixedly connected on a handle 7. According to some aspects, the shaving cartridge 1, 1' may also be able to pivot relative to the handle 7, in one or more directions, or according to other aspects, the shaving cartridge 1, 1' may be fixed. For example, at the sides of the guard bar 3', there may be recesses 33' for attaching a handle 7 which may allow the shaving cartridge 1' to pivot.

There are various methods, and combinations thereof, that may be used for manufacturing the shaving cartridge 1. An aspect may include:

- producing the housing 2 of the shaving cartridge 1, by using the appropriate method based on the material of the housing 2,
- preparing the cutting elements 5 including connecting structures 506 at each end, and
- assembling the cutting elements 5 on the housing 2.

According to further aspects, the method for manufacturing the shaving cartridge may include:

- Configuring support portions with respect to the connection connecting structures,
- attaching a guard bar and/or a cap to the support portions,
- forming the cutting elements,
- selecting a desired number of cutting elements, attaching adjacent cutting elements to form a chain,
- attaching the guard bar assembly on the first or front blade assembly, and attaching the cap assembly to the last or the back-cutting element assembly.

According to aspects, the housing 2 may be made of a moldable material, or any other known material. The housing 2 may be manufactured in one step, using various methods, including the retaining structures 212. For example, the housing 2 and retaining structures 212 may be formed using injection molding, 3D printing, or other similar techniques. However, according to other aspects, the housing 2 may be manufactured in a plurality of steps. For example, if the housing 2 is made of metal, and the retaining structures 212 may be formed in a second step. According to some aspects, a plurality of steps may be beneficial especially when the housing 2 may include left and right walls 206, 207, and may be made of an elastic material that may allow the housing 2 to flex and follow the skin contour 6. According to further aspects, the left and right walls 206, 207 may include two parts each being attached via a connecting structures 506 that may allow the two parts to pivot relatively, along an axis parallel to axis X. Again, the shaving cartridge 1 may follow more closely the curves of the skin.

The cutting elements 5 may be produced according to the method described in the International patent application WO2010069389, also published as U.S. Pat. No. 9,440,282. The connecting structures 506 may be formed during the step of forming the supporting portion 501 of the cutting element 5 or in an additional step. According to aspects where the supporting portion 501 and the blade portion 502 may be integral, the connecting structures 506 may be formed before forming the cutting edge 503 of the cutting elements 5.

According to some aspects, the individual mounting of each of the cutting elements 5 on the housing 2 may be done by press-fitting the connecting structures 506 of the cutting elements 5 in the corresponding retaining structures 212 of the housing 2. According to further aspects, and depending on the form of the attaching portion 507 of the cutting element 5, the connecting structures 506 may be snap-fitted on the housing 2.

According to aspects where the cutting elements 5 form a chain-like effect, the cutting elements 5 may be first assembled between the connecting structures 506, forming a cutting element chain, and then the two extreme cutting elements 5 (i.e. the front and rear cutting elements 5) may be assembled on the housing 2.

While the embodiments have been described in detail in the foregoing description, the same is to be considered as illustrative and not restrictive in character, it being understood that only some embodiments have been shown and described and that all changes and modifications that come within the spirit of the embodiments are desired to be protected.

While the particular embodiments of the present disclosure have been described, it would be obvious to those skilled in the art that various other changes and modifications may be made without departing from the spirit and scope of the disclosure. It is therefore intended to cover in the appended claims all such changes and modifications are within the scope of the disclosure.

The invention claimed is:

1. A razor cartridge comprising:

a housing having a front wall, a rear wall opposing the front wall, at least two retaining structures, and at least two cutting elements;

each of the at least two cutting elements having a first end and a second end, the at least two cutting elements each including connecting structures at the first end and the second end;

the connecting structures each including a cutting element attaching portion and a cutting element receiving portion;

the connecting structures being configured to allow the at least two cutting elements to be attached to the housing;

the attaching portion of one of the at least two cutting elements being attached to the receiving portion of the other of the at least two cutting elements.

2. The razor cartridge according to claim 1, wherein the housing further includes a left inner wall, a right inner wall opposite the left inner wall, the at least two retaining structures being disposed, respectively, on the left and right inner walls.

3. The razor cartridge according to claim 1, wherein the connecting structures of the at least two cutting elements are attached, respectively, to the at least two retaining structures of the housing.

4. The razor cartridge according to claim 1, wherein each of the at least two retaining structures incudes a retaining structure receiving portion.

5. The razor cartridge of claim 4, wherein each of the retaining structure receiving portions includes a recess.

6. The razor cartridge according to claim 1, wherein each of the at least two retaining structures includes a retaining structure attaching portion.

7. The razor cartridge of claim 6, wherein the retaining structure attaching portion includes a protrusion.

8. The razor cartridge according to claim 6, wherein the at least two cutting elements includes a plurality of cutting elements, the plurality of cutting elements being linked together to form a cutting element chain.

9. The razor cartridge of claim 1, wherein one of the at least two cutting elements is attached to the housing adjacent the front wall of the housing and the other of the at least two cutting elements is attached to the housing adjacent the rear wall of the housing.

* * * * *